US005484541A

United States Patent [19]

Przybylski et al.

[11] Patent Number: 5,484,541

[45] Date of Patent: Jan. 16, 1996

[54] PROCESS AND PRODUCT FOR LUBRICATING METAL PRIOR TO COLD FORMING

[75] Inventors: Gerald W. Przybylski, Naperville, Ill.; Patrick J. Connor, Brighton; David W. Peters, Rochester, both of Mich.

[73] Assignee: Century Chemical Corporation, Naperville, Ill.

[21] Appl. No.: 245,244

[22] Filed: May 17, 1994

[51] Int. Cl.[6] ..... C10M 129/40

[52] U.S. Cl. ..... 252/17; 252/39; 252/40; 252/49.3

[58] Field of Search ..... 252/17, 39, 40, 252/49.3; 72/42

[56] References Cited

U.S. PATENT DOCUMENTS

| | | | |
|---|---|---|---|
| 2,354,072 | 7/1944 | Swift | 252/40 |
| 2,413,220 | 12/1946 | Elder et al. | 252/39 |
| 3,775,323 | 11/1973 | Dubourg | 252/49.5 |
| 3,836,467 | 9/1974 | Jones | 252/18 |
| 4,029,682 | 6/1977 | Foulks, Jr. | 252/39 |
| 4,759,861 | 7/1988 | Ogura et al. | 252/49.3 |
| 5,356,544 | 10/1994 | Zilberman et al. | 252/17 |
| 5,368,757 | 11/1994 | King | 252/49.3 |
| 5,389,199 | 2/1995 | Awad et al. | 252/49.3 |

OTHER PUBLICATIONS

Technical Data Sheet IC–1A–for Borax, by United States Borax & Chemical Corporation © 1982; 1992 Month Unavailable.

Product Data Sheet for Drymet 59, by Crosfield Company, Issue Date Apr. 1994.

Crosfield Metasilicates Catalog, by Crosfield Company, pp. 2–3 date unavailable.

Technical Data Brochure for C–Lube–, by Century Chemical Corporation date unavailable.

Technical Bulletin for Pluracol E4500 Polyethylene Glycol, by BASF Corporation date unavailable.

Technical Data Brochure for Carbowax Polyethylene Glycols, by Union Carbide–Industrial Chemicals Div Month Unavailable pp. 2–5, 26. ©1986.

Technical Data Brochure for Triton Surfactants–Hydrotropes H–55, H–66 and QS–44, by Union Carbide Chemicals and Plastics Company, Inc. ©1991 Month Unavailable.

Technical Data Brochure for Barium Sterate, by Witco Chemical Corporation date unavailable.

Technical Data Brochure for C–Lube 10, by Century Chemical Corporation data unavailable.

Technical Data Brochure for Lithium Stearate PM, by Witco Chemical Corporation, Organics Division.

Technical Data Brochure for Calcium Stearate Regular, by Witco Corporation date unavailable.

(List continued on next page.)

*Primary Examiner*—Jacqueline V. Howard

*Attorney, Agent, or Firm*—Basile and Hanlon

[57] ABSTRACT

A composition for lubricating a metal workpiece prior to cold forming consists essentially of: an aqueous alkaline stearate compound present in an amount sufficient to impart metal lubrication between about 180° F. and about 320° F.; an aqueous alkaline palmitate compound present in an amount sufficient to impart metal lubrication below about 160° F.; an aqueous metallic stearate compound present in an amount sufficient to impart metal lubrication between about 320° F. and 440° F.; a polymeric glycol present in an amount sufficient to provide temperature stability, act as a carrier for the aqueous compounds, and impart a waxy lubrication to the metal; a compound present in an amount sufficient to act as a carrier for the aqueous compounds and to provide a translucent film barrier on the metal; an alkaline buffering agent present in an amount sufficient to provide dispersion, viscosity and stability; a hydrotropic agent present in an amount sufficient to solubilize the lubricating composition. A process is disclosed for lubricating a metal workpiece outer surface prior to cold forming, the process comprising the step of disposing a non-reactive lubricating composition on the workpiece outer surface, the outer surface having been alkaline cleaned, hot water rinsed, acid pickled, and cold water rinsed.

35 Claims, 2 Drawing Sheets

OTHER PUBLICATIONS

Technical Data Brochure for Tamol 960, by Rohm and Haas Company, ©1981 Month Unavailable.
Product Safety Information for Phosphoric Acid 75%, 80% and 85%, by Stauffer Chemical Company.
Caustic Soda Handbook, by Vulcan Chemicals pp. 31–33. date unavailable.
Technical Bulletin for Golpanol MBS, by BASF Corporation, Chemicals Division date unavailable.
Technical Bulletin–Performance Review for Golpanol MBS, by BASF Corporation.
MSDS Sheet for Borax, by U.S. Borax, Inc. ©1993 Month Unavailable.
MSDS Sheet for Sod. Metasilicate Ann. Drymet, by EMCO Chemical Distributors, Inc., Rev. Date: Oct. 1985.
MSDS Sheet for C–Lube 16, by Century Chemical Corporation, Prep. date: Jan. 1994.
MSDS Sheet for Carbowax Polyethylene Glycol 4600 or 4600 Flake, by Union Carbide Chemicals & Plastics Co., Inc. eff. date: Aug. 1992.
MSDS Sheet for Triton H–66 Surfactant, by Union Carbide Chemicals & Plastics Co., Inc., eff. date Oct. 1993.
MSDS Sheet for Barium Stearate, by Witco, Organics Division, Rev. Date: Jun. 1989.
MSDS Sheet for C–Lube 10, by Century Chemical Corporation, Date Prepared: Jan. 1994.
MSDS Sheet for Lithium Stearate (All Grades), by Witco, Organics Division, Rev. Date: Jun. 1992.
MSDS Sheet for Calcium Stearate (All Grades), by Witco, Organics Division, Rev. Date: Jun. 1992.
MSDS Sheet for Tamol 960 Dispersing Agent, by Rohm and Haas Company, date: Dec. 1993.
MSDS Sheet for Albrite Phosphoric Acid 85 PCT., Tech Grade, by The Albright and Wilson Company, Environmental Services date unavailable.
MSDS Sheet for Caustic Soda Liquid 50%, by Emco Chemical Distributors, Inc., Rev. Date: Jun 1985.
MSDS Sheet for Colpanol MBS–Sodium–M–Nitro Benzene Sulfate, by BASF Wyandotte Corporation.
MSDS Sheet for Metso Beads 2048, by the PQ Corporation, Date: Mar. 1991.

PROCESS AND PRODUCT FOR LUBRICATING METAL PRIOR TO COLD FORMING

BACKGROUND OF THE INVENTION

The present invention relates generally to a process and product for lubricating metal, and more particularly to such a process and product used prior to cold forming of the metal.

Chemical lubricant compositions span a broad range covering metal working fluids and coolants, of both oil, and oil in water emulsions and water base "synthetic" mixtures, as well as heavy oils, powders, pastes and greases, which all perform the lubricant functions of reducing contact friction, transferring heat, and allowing a physical or mechanical operation to take place.

"Cold forming" of metal generally entails various work operations at room temperature such as extrusion of metal backward or forward; drawing; ironing; forming; and the like. For example, a metal wire may be drawn to a specific diameter through a die, or metal tubing to a specific wall thickness and diameter over a mandrel, or a metal shape may be formed through a press or heading machine. Each of these operations requires a continual reporting or lubricating layer having good "slip" characteristics, ie. no metal to metal contact, between the tooling and the work piece. The chemical and physical characteristics of this reporting layer determine the feasibility of the extrusion, as well as the tool life.

Presently, the majority of metal parts (such as steel parts) to be cold drawn are prepared with a zinc phosphate coating, chemically reacted with a buffered sodium stearate lubricant, while in other situations, a zinc phosphate coating is coupled with a combined inorganic or organic lubricant referred to as non-reactive soap coating. For more severe extrusions, the zinc phosphate coated stock may be tumbled with molybdenum disulfide. This metal preparation generally includes the following steps: alkaline cleaning; a hot water rinse; a sulfuric acid pickle; a cold water rinse; a hot water rinse; a zinc phosphate application; a cold water rinse; an alkaline neutralizer; and an application of a reactive organic soap lubricant.

In the steel industry, unlike a layer of paint or oil on the steel surface, the zinc phosphate layer is a conversion coating, which reacts with the base steel and utilizes a portion of it into the coating itself. The resulting precipitation is a mixture of iron from the steel with zinc and phosphate from the phosphate solution which forms zinc-iron phosphate crystals that are chemically bonded to the steel surface. This crystal pattern builds uniformly across the steel surface during immersion in the zinc phosphate bath until the characteristic sparkling grey coating covers the surface. The phosphate coating does not inherently provide lubricity, but it does provide a non-metallic barrier between the steel being extruded and the tools performing the deformation. Although this barrier role is important, the greater function of the zinc phosphate is to retain and react with subsequent carriers and lubricants. These subsequent layers are important for providing relief at critical points of reduction and cold drawing when tools and dies need to allow the passing metal surface to flow freely and smoothly.

The steps involved in the coating deposition are pickling, acceleration, coating and sludge. These steps are repeated each time a clean steel piece enters the solution. After these steps, the steel surface has an anchored crystalline structure thereon which serves two purposes for lubrication. The first purpose is "retention" of lime or stearate soaps, either applied in the pickle/process line or as a dry box lubricant prior to drawing. This is accomplished simply by the physical "sponge" nature of the crystal lattice, which is able to hold large quantities of inorganic lime and/or organic soaps. For some subsequent forming operations, the sheer quantity of retained soap will be the basis for the success of the operation. In other instances, the composition of the retained soap will play the key role. In still other applications, both quantity and composition will be influential. The second purpose is the chemical "reaction" with sodium and calcium stearate soaps. The stearate compounds, via a reactive soap tank or from within a dry box soap, displace the phosphate chemically connected to the zinc and bond directly to the zinc site. This bonded zinc stearate possesses a wide plastic range and high melting point necessary for difficult extrusions.

Current alternatives to the zinc phosphate procedure are oil replacements which are untidy, costly and environmentally unsound, as well as being of only limited effectiveness. In fact, the zinc phosphate procedure itself contains a high concentration of soluble zinc which requires profuse rinsing and subsequent waste water treating and hazardous disposal. Further, a lesser percentage of soluble nickel normally is incorporated into zinc phosphate mixtures, which faces even greater effluent restrictions. Still further, a natural and inevitable byproduct of the zinc process involves the generation of an insoluble, zinc bearing sludge in the process tank itself, which requires periodic solution decants and additional hazardous waste disposal. Yet another drawback lies in the fact that all of the solutions used in the zinc phosphate procedure have a relatively short lifespan in reference to square footage of metal processed and/or weeks of productivity. Desludging and discarding of solutions impede production, add costly labor time to the process, and contribute greatly to waste treatment costs and permanent hazardous disposal sites.

Thus, it is an object of the present invention to provide a process and product for lubricating metal prior to cold forming of the metal which is as, if not more effective than current zinc phosphate treatments, while being more efficient and more environmentally sound. Further, it is an object of the present invention to provide such a process and product which does not require profuse rinsing and subsequent waste water treating and hazardous disposal. Still further, it is an object of the present invention to provide such a process and product which does not require periodic solution decants and additional hazardous waste disposal of sludge. Yet still further, it is an object of the present invention to provide such a process and product which has a relatively long lifespan in reference to square footage of metal processed and/or weeks of productivity.

SUMMARY OF THE INVENTION

The present invention addresses and solves the problems enumerated above. The present invention comprises a composition for lubricating a metal workpiece prior to cold forming. The composition consists essentially of an aqueous alkaline stearate compound adapted to, and present in an amount sufficient to impart metal lubrication between about 180° F. and about 320° F. An aqueous alkaline palmitate compound is adapted to, and is present in an amount sufficient to impart metal lubrication below about 160° F. An aqueous metallic stearate compound is adapted to, and is present in an amount sufficient to impart metal lubrication between about 320° F. and 440° F. A polymeric glycol is adapted to, and is present in an amount sufficient to provide temperature stability, act as a carrier for the aqueous compounds, and impart a waxy lubrication to the metal. The composition further consists essentially of a compound adapted to, and present in an amount sufficient to act as a carrier for the aqueous compounds and to provide a translucent film barrier on the metal. An alkaline buffering agent is adapted to, and is present in an amount sufficient to provide dispersion, viscosity and stability. Further, a hydrotropic agent is adapted to, and is present in an amount sufficient to solubilize the lubricating composition.

The present invention further comprises a process for lubricating a metal workpiece outer surface prior to cold forming, the process comprising the step of disposing a non-reactive lubricating composition on the workpiece outer surface, the outer surface having been alkaline cleaned, hot water rinsed, acid pickled, and cold water rinsed.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
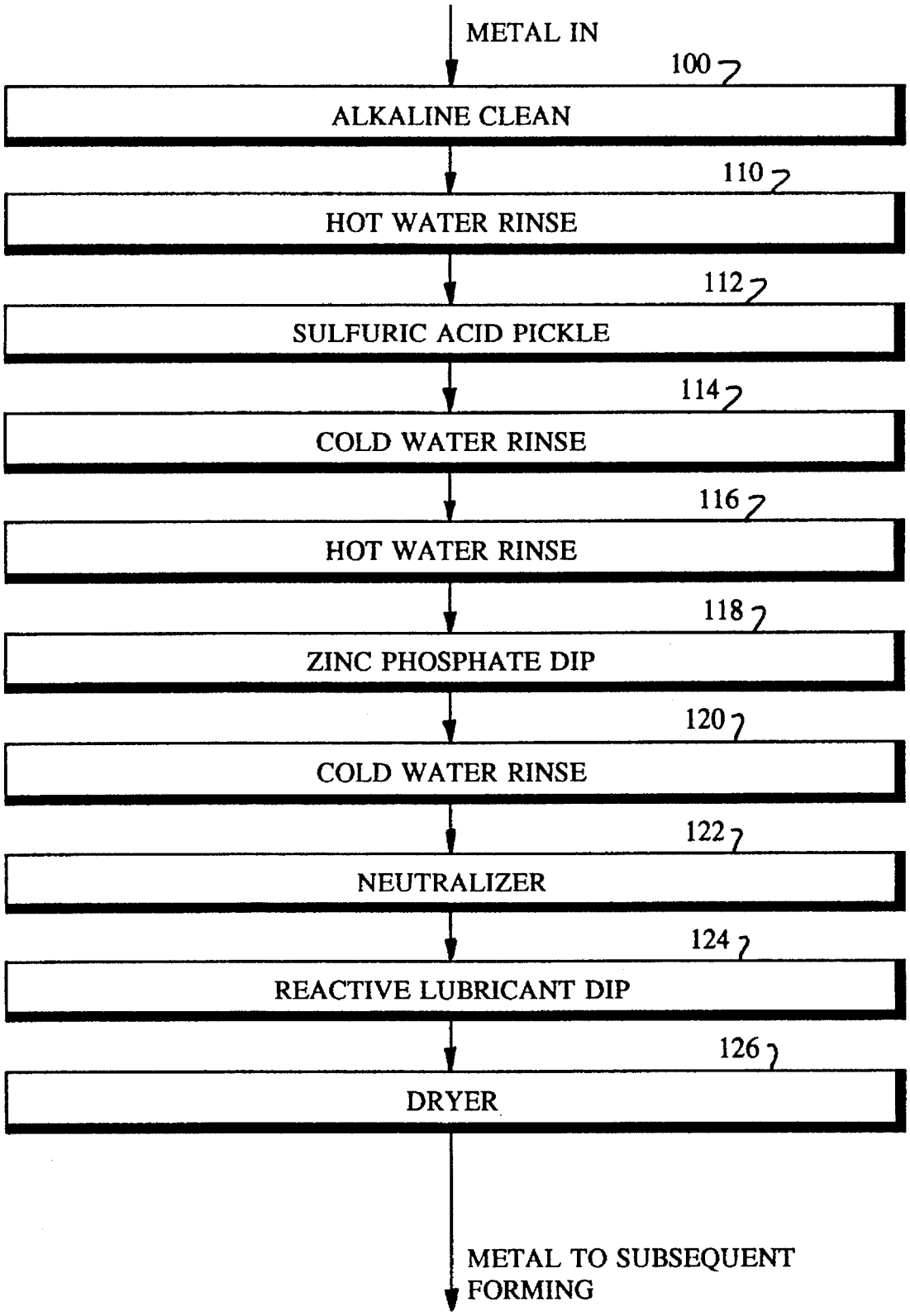
FIG. 1 is a flow diagram of a prior art process for lubricating metal prior to cold forming.

The present invention comprises a composition for lubricating a metal workpiece prior to cold forming. This inventive lubricating composition consists essentially of an aqueous alkaline stearate compound adapted to, and present in an amount sufficient to impart metal lubrication between about 180° F. and about 320° F. It is to be understood that any suitable alkaline stearate compound may be used, however, in the preferred embodiment, this alkaline stearate compound is selected from the group consisting of sodium stearate, calcium stearate, and mixtures thereof. These compounds may be added in any suitable weight percentage, however, the weight percentage of the sodium stearate compound ranges between about 10% to 20%. A preferred weight is about 15%. It is to be understood that various equivalent compounds may be substituted for the sodium stearate, which is a sodium salt of a carboxylic acid bearing 18 carbons. One such equivalent includes sodium salts of 14 carbon bearing carboxylic acids (myristic acid) and 16 carbon bearing carboxylic acids (palmitic acids). Further equivalents include potassium salts of the same 14, 16 and 18 carbon designations.

It is to be understood that any suitable alkaline stearate compound having lubrication between about 180° F. and 320° F. may be used. One such suitable compound is known as C-LUBE 10 commercially available from Century Chemical Corporation in Naperville, Ill. C-LUBE 10 is a sodium stearate, and it is to be understood that other sodium stearates may be used. It is a non-hazardous stearate soap less than about 100% by weight. Its solubility in water at 160° F. is 150 g/1. It is an off-white, free-flowing powder with a bland odor. It is a stable compound. An illustrative example of how to make this compound will appear in the examples hereinafter.

The calcium stearate may also be added in any desired and suitable weight percentage, however, in the preferred embodiment, this percentage ranges between about 6% to 12%, with a preferred weight percentage at 8%. It is to be understood that the composition of the present invention contemplates various equivalent structures suitable for use herein. Of these, it is contemplated that calcium salts of 14 carbon bearing carboxylic acids (myristic acid) and calcium salts of 16 carbon bearing carboxylic acid (palmitic acid) are suitable. Further, magnesium salts of the same designation are also suitable alternatives.

An example of a suitable calcium stearate compound is commercially available from Witco Chemical Corporation of Chicago, Ill., under the trade name Calcium Stearate Regular. Its moisture has a maximum of 2.5%; the total ash is between about 9.0% and about 10.5%; the free fatty acid has a maximum of 2.0%; the fineness through 325 mesh is 99.0%; the typical apparent density is 24 lb/ft$^3$. The chemical name is octadecanoic acid, calcium salt. Its formula is $(C_{17}H_{35}COO)_2Ca$. It appears as a white powder having a slight fatty odor. Its specific gravity is 1.03 and its melting point is 320° F. Its solubility in water is negligible and it is stable under normal conditions.

The lubricating composition of the present invention further consists essentially of an aqueous alkaline palmitate compound adapted to, and present in an amount sufficient to impart metal lubrication below about 160° F. It is to be understood that this palmitate compound may comprise any suitable compound. However, in the preferred embodiment, sodium palmitate is used. It is to be understood that this compound may be present in any suitable weight percentage, however, in the preferred embodiment, this ranges between about 10% to about 20%, and still more preferred, 11%. It is to be understood that various equivalent structures are also contemplated in the present invention, and any such suitable structures may be used. Some suitable alternatives include the sodium salts of 14 carbon bearing carboxylic acids (myristic acid). Further alternates include potassium salts of the same 14 and 16 carbon designations.

It is to be understood that any suitable sodium palmitate may be used; however, in the preferred embodiment, one such compound used is commercially available from Century Chemical Corporation in Naperville, Ill. under the trade name C-LUBE 16. This is a non-hazardous stearate soap less than about 100% by weight. Its solubility in water at 160° F. is 240 g/1. It appears as an off-white, free-flowing powder with a bland odor. It is a stable compound. An example of how to make this compound will appear in the examples hereinafter.

The lubricating composition of the present invention further consists essentially of an aqueous metallic stearate compound adapted to, and present in an amount sufficient to impart metal lubrication between about 320° F. and about 440° F. It is to be understood that any suitable compound may be used, however, in the preferred embodiment, this metallic stearate compound is selected from the group consisting of barium stearate, lithium stearate, and mixtures thereof. It is to be understood that the barium stearate compound may be present in any suitable weight percentage, however, in the preferred embodiment, this ranges between about 10% and about 25%, with a preferred weight percentage of 18%. It is to be understood that various alternative compounds are contemplated for use in the present invention, and may successfully be used herein. Of these, the barium salts of both the 14 and 16 carbon chain carboxylic acids may successfully be employed. Further alternates include aluminum salts of the same 14, 16 and 18 carbon designations.

An example of a suitable barium stearate is commercially available from Witco Chemical Corporation in Chicago, Ill.

The barium stearate moisture percentage is a maximum of 1.0; the total ash percentage at 750° C is between about 28.0 and 30.0; the free fatty acid has a maximum of 1.0%; and the fineness through 200 mesh is 99.0%. The chemical name is barium stearate-barium soap. The formula is $Ba(OOCC_{17}H_{35})_2$. It appears as a white powder having a slight fatty odor. Its specific gravity is 1.23, and its melting point is 320° F. Its solubility in water is negligible.

It is to be understood that the lithium stearate may be present in any suitable weight percentage. In the preferred embodiment this percentage ranges between about 890 and 25%, with a preferred percentage by weight of the composition of 11%. It is to be understood that various suitable alternate structures are contemplated as being capable for successful use in the present composition. Among these suitable alternates are the lithium salts of the 14 and 16 carbon chain carboxylic acids. Other suitable alternates may include the aluminum salts of the same 14, 16 and 18 carbon designations.

An example of a suitable lithium stearate compound is commercially available from Witco Chemical Corporation in Chicago, Ill. and available under the trade name lithium stearate PM. Its maximum moisture is 1.0%; the lithium content is between about 2.4% and about 2.6%; the free fatty acid is not more than 0.5%; the free alkalinity is not more than 0.02%; and the fineness through 200 mesh is 99.0%; and through 40 mesh is 100.0%. Its chemical name is lithium salt of commercial stearic acid. Its formula is $LiC_{18}H_{35}O_2$. It appears as a white powder having a slight fatty odor. Its specific gravity is 1.01 and its melting point is 414° F. It is insoluble in water.

The lubricating composition of the present invention further includes a polymeric glycol adapted to, and present in an amount sufficient to provide temperature stability, act as a carrier for the aqueous compounds, and impart a waxy lubrication to the metal. It is to be understood that any suitable polymeric glycol may be used; however, in the preferred embodiment, this glycol is selected from the group consisting of polyethylene glycol, polypropylene glycol, and mixtures thereof. These polymeric glycols may be of any suitable molecular weight. However, in the preferred embodiment, this molecular weight ranges between about 400 and about 8000, more preferably between 2000 and 4600, and still more preferably this polymeric glycol has a molecular weight between about 4500 and about 4600. In the preferred embodiment, PEG 4500 is used. This is the polyethylene glycol having a molecular weight of 4500. It is to be understood that the polymeric glycol may be present as any suitable weight percent of the present lubricating composition; however, in the preferred embodiment, this percentage is between about 4% and about 12%, with a preferred weight percentage of 10%

An example of a suitable polymeric glycol is commercially available from Dow Chemical U.S.A. in Midland, Mich. under the trade name POLYGLYCOL E4500. This is a hard, white, wax-like solid, soluble in water. Its chemical formula is $HO(C_2H_4O)_{101}C_2H_4OH$. Its average molecular weight is 4500, and its viscosity at 210° F. is 170 cs. Its freezing point is 58° C., and its specific gravity at 25° C. is 1.224. Its color (APHA), 25% in water is 10–20. It has a neutral pH, and its ash content is nil.

Another suitable polymeric glycol is commercially available from Union Carbide Corporation located in Danbury, Conn. under the trade name CARBOWAX POLYETHYLENE GLYCOL 4600. Its average molecular weight ranges between about 4400 to 4800. Its pH in a 5% aqueous solution at 25° C. ranges between 4.5 and 7.5. In a 25% aqueous solution, the water solubility indicates a solution free from haze or turbidity. The viscosity at 210° F. ranges between 150 and 210 cst.

Another suitable polymeric glycol is commercially available from BASF Wyandotte Corporation in Wyandotte, Mich. under the trade name PLURACOL E4600. This is a polyethylene glycol having an average molecular weight of 4600.

The lubricating composition of the present invention further consists essentially of a compound adapted to, and present in an amount sufficient to act as a carrier for the aqueous compounds and to provide a translucent film barrier on the metal. It is to be understood that this compound may be any suitable compound; however, in the preferred embodiments, this compound is a sodium tetraborate. The sodium tetraborate, ie. BORAX, used may be either 5 or 10 mole (waters of hydration). It is to be understood that this may be present in any suitable weight percentage of the lubricating composition, however, in the preferred embodiment, this weight percentage ranges between about 15% to 50%, with a preferred percentage between about 22% and about 45%, and still more preferred the weight percent is about 22%. It is to be understood that various alternates may successfully be employed. Of these, it is contemplated that potassium tetraborate may be used.

It is to be understood that any suitable compound may be used which acts as a carrier for the aqueous compounds and provides a translucent film barrier on the metal. In the preferred embodiment, a sodium tetraborate compound is used. One such suitable compound is commercially available from United States Borax and Chemical Corporation in Los Angeles, Calif. under the trade name BORAX 5-MOL. Its chemical name is sodium tetraborate pentahydrate. It comes from the borate chemical family. Its CAS number is 1330-43-3, and its formula is $Na_2B_4O_7.5H_2O$. It is a white, odorless crystalline solid having a specific gravity of 1.815 and a melting point of 200° C. It is 3.60% soluble in water at 20° C. and 50.13% soluble in water at 100° C. When dissolved in water, hydration to the decahydrate takes place. The pH of a 3% solution at 20° C. is 9.25. It is a stable compound.

The lubricating composition of the present invention further comprises an alkaline buffering agent adapted to, and present in an amount sufficient to provide dispersion, viscosity and stability. It is to be understood that any suitable alkaline buffering agent may be used, however, in the preferred embodiment, sodium metasilicate anhydrous is used. This is also known as SMS anhydrous. One such suitable compound is commercially available from Rhone-Poulenc, Inc. in Cranberry, N.J. under the tradename DRYMET. It is to be understood that this may be present in any suitable weight percentage; however, it is preferred that this range is between about 2% and about 5%, and still more preferably the sodium metasilicate is present at about 3 weight percent. It is to be understood that suitable alternates may be used in the present invention. Of these, it is contemplated that potassium silicates, other alkaline salts such as trisodium phosphate (TSP) and tetrasodium polyphosphate (TSPP) will function with suitable buffering capabilities. SMS crystalline may also be used; however, when using a compound such as CRYSTAMET®, it would be necessary to use about 1.74 lb. of it to every 1 lb. of the anhydrous material in order to obtain an equivalent amount in solution.

It is to be understood that any suitable sodium metasilicate may be used. One such suitable sodium metasilicate is commercially available from the PQ Corporation located in Valley Forge, Pa. under the trade name METSO BEADS® 2048 anhydrous sodium metasilicate. Its chemical name is silicic acid, disodium salt. This compound appears as odorless, white granules having a bulk density of 68 lbs/ft$^3$ untamped. The solubility in water is appreciable, and the pH is 13 to 14—water solutions are very alkaline. The product is stable, but incompatible with hot water and concentrated acids.

A suitable crystalline sodium metasilicate is commercially available from Rhone-Poulenc, Inc. in Cranberry, N.J. under the trade name CRYSTAMET® sodium metasilicate, pentahydrate. A synonym is silicic acid, disodium salt. Its formula is $Na_2SiO_3.5H_2O$, and its molecular weight is 212.14. It is a white granular solid having a loose bulk density of approximately 55 lbs/st$^3$. It is 61 g/100 g soluble in water at 86° F., and its pH is 12.4 in a 1% aqueous solution.

Another suitable sodium metasilicate is commercially available from EMCO Chemical Distributors, Inc. in North Chicago, Ill., while the producer is Diamond Shamrock Chemical Company in Irving, Tex. The chemical name is silicic acid, disodium salt. Its trade name and synonyms are SMSA, SPECIAL 25, ANHYDROUS METASILICATE. Its CAS Reg. No. is 6834-92-0. It is 100% sodium silicate and it may be treated as caustic. Typical physical data include a vapor density of 2.4 g/ml at 77° F. It is 18% soluble in water and appears as a white granular or powdered solid having no odor. The compound is stable under ambient conditions. The material is alkali in nature and is not compatible with strong acids.

The lubricating composition of the present invention further comprises a hydrotropic agent adapted to, and present in an amount sufficient to solubilize the lubricating composition. It is to be understood that any suitable hydrotropic agent may be used. This hydrotropic agent aids in preventing the soluble and insoluble components of the present invention from separating into a diphase solution. In the preferred embodiment, a potassium salt of phosphate ester is used. The hydrotopes may be present in any suitable amount; however, in the preferred embodiment, it ranges between about 2% and 10% by weight, and more preferably at about 4% by weight. It is to be further understood that various alternate compounds may be used. For example, TRITON H-55, also commercially available from Union Carbide, may be used. Further, phosphate esters, such as GAF RA-600 and RA610 and generic equivalents may be used. Still further, other chemical hydrotropes such as sodium xylene sulfonate (SXS) (Steppan-Steppanate X) and generic equivalents may be used.

It is to be understood that any suitable hydrotropic agent may be used. One such suitable compound is commercially available from Union Carbide Chemicals and Plastics Company, Inc. in Danbury, Conn. under the trade name TRITON H-66 Surfactant. Its chemical name is alkyl aryl alkoxy potassium salt. A synonym of this is a phosphate ester potassium salt anionic surfactant. Typical physical characteristics include a boiling point at 760 mm Hg of 213° F., and a specific gravity of 1.256. Its freezing point is −6° F., and its vapor pressure at 20° C. is 13.38 mm Hg. Its evaporation rate is 0.93, and its vapor density is 1.20. It is 100% soluble in water at 20° C., and its appearance is transparent yellow. It has a pungent odor and is a liquid. Its percent volatiles is 50% by weight. Its ingredients include 50% of a phosphate ester potassium salt, and 50% water. It is a stable compound.

Another suitable hydrotropic agent is TRITON® H-55. This is a phosphate ester potassium salt having a clear, light-amber liquid appearance. The specific gravity at 25° C. is 1.35, while the viscosity at 25/25° C is 40 cP. The density at 25° C. is 11.2 lb/gal. The pH ranges between 8 and 10. It is stable in acidic and alkaline solutions, but may undergo slow hydrolysis in neutral solutions. In dry mixes, it will remain sufficiently stable if used in direct contact with solid caustic. It is soluble in water and water-miscible solvents, but insoluble in less polar solvents. The lubricant of the present invention is a water-based mixture of insoluble and soluble ingredients, physically agitated and chemically dispersed, which lends to uniform coating of insoluble components. When deposited on the metal surface to be lubricated, this layer is simply disposed upon the surface rather than the previous lubricant layers which had actually reacted with the metal surface.

The lubricating composition of the present invention may further consist essentially of a dispersing agent for maintaining the aqueous compounds and solutions; and a polyelectrolyte for imparting a cohesive film strength to the lubricating composition as it is dried on the metal workpiece. It is to be understood that any suitable dispersing agent and polyelectrolyte may be used. In the preferred embodiment, one compound serves both functions. This compound is a sodium salt of polymeric carboxylic acid, such as TAMOL 960. It is to be understood that separate suitable compounds performing each of the functions may be used, as well as an alternate compound which may perform both functions. It is to be understood that any suitable weight percentage may be used. In the preferred embodiment, this percentage of the lubricating composition weight ranges between about 0.1% and about 5%, with a preferred percentage of 3.0%. It is to be understood that any suitable equivalent compound may be used. It is contemplated that ammonia or potassium salts of the same acids (TAMOL 961), as well as sodium and ammonia salts of naphthalene sulfonic acids (TAMOL SN 819) may successfully be employed.

TAMOL® 960 is commercially available from Rohm and Haas Company located in Philadelphia, Pa. This compound is the solution of the sodium salt of a carboxylated acrylic polyelectrolyte. This is an efficient dispersant for kaolin clay. TAMOL® 960 is a primary dispersant in the pH range 6-10. It is also a secondary dispersant, providing excellent heat-aging stability to pre-dispersed clay slurries. Typical properties of this compound include the following. It appears as a clear liquid and has a solids content of 40%. The pH as packed at 25° C. is 7.0–9.0, generally 7.0. The Brookfield LVS Viscosity at 25° C. (#2 spindle, 30 rpm) is 300–800 cps., generally 550 cps. The color (APHA) is 200 max. The specific gravity at 25° C. is 1.0–1.275, generally 1.275. The density at 25° C. is 10.63 lb/U.S. gal. The solubility is infinite in water. The TAMOL® 960 contains 39–41% of the sodium salt of polymeric carboxylic acid; less than 0.1% of individual residual monomers; not more than 0.07% formaldehyde (CAS Reg. number 50-00-0); and 59–61% water. The material is considered stable, however, at temperatures above about 350° F., polymer decomposition begins.

Without being bound to any theory, it is believed that the use of a organic dispersing agent in the present invention, such as, for example, the TAMOL 960, may also encapsulate the metallic stearates at room temperature. Soluble barium compounds are regulated and limited to 100 ppm total leachable barium using the EPA toxicity procedure. Therefore, since the dispersing agent may be encapsulating the barium, the barium has been found to be non-leachable at room temperature. Thus, any barium used is insoluble and non-hazardous in the process tank, and, when eventual disposal of the lubricant composition of the present invention may be required, the solidified lubricant composition may be discarded as non-hazardous waste. Further, since any contaminants introduced into the process tank containing the lubricant composition during metal lubrication has not shown any interference with the performance of the lubricant of the present invention, it appears that, as opposed to being relatively short as with the lubricant compositions of the prior art, the life span of the lubricant composition of the present invention is quite long, if not indefinite.

A further aspect of the present invention comprises a specific pre-treatment conditioner for depositing an iron phosphate/oxide conversion coating on the metal or steel workpiece prior to lubrication and cold forming. This coating consists essentially of an inorganic acidic salt for laying down the coating; and an organic accelerator for increasing the amount of coating laid down. It is to be understood that any suitable inorganic acidic salt may be used. However, in the preferred embodiment, mono-sodium phosphate is used. This is commercially available but, in the preferred embodiment, this is formed by the reaction of phosphoric acid with sodium hydroxide to yield mono-sodium phosphate and water. Suitable alternates include all iron phosphatizing solutions. It is to be understood that any suitable percentage of the mono-sodium phosphate may be used; however, in the preferred embodiment this has a working concentration of 3%–10% by volume of the conditioner blend, with a more preferred concentration of 5% by volume of the conditioner blend.

It is to be understood that any suitable phosphoric acid may be used. One such suitable phosphoric acid is commercially available from the Albright and Wilson Company located in Richmond, Va. It is sold under the trade name Albrite Phosphoric Acid 75%, food grade. It is an odorless, colorless liquid having a relative density of 1.58 and a melting point of –6° F. The boiling point is 275° F. and the vapor pressure is 5.7 mm Hg. The viscosity at 100° F. is 51.4 SUS, and at 210° F. is 34.7 SUS. Solubility in water is appreciable, and the pH is 1.0.

It is to be understood that any suitable caustic may be used. One such suitable compound is a Caustic Soda Liquid –50% commercially available from LCP Chemical in Edison, N.J. Its chemical name is sodium hydroxide liquid, and synonyms include liquid caustic soda, soda lye solution, and sodium hydrate. Its chemical formula is NaOH, and it is an alkali. The principal component is 50% NaOH, and the balance is water (the regular grade may contain 1.3% NaCl). Its boiling point is 280° F. to 310° F., and its specific gravity is 1.530. It is a colorless, viscous liquid having no odor. It will not evaporate at ambient temperature, and its solubility in water is complete. Its viscosity at 68° F. is 100 cps. It is stable under normal conditions.

The organic accelerator preferred is sodium meta nitrobenzene sulfonate. It is to be understood that any suitable alternate may be used as the organic accelerator. One such suitable alternate is hydroxyl amine sulfonate. Although not as preferred, inorganic accelerators may also be used, such as sodium chlorate, and sodium bromate. The accelerator is preferably present in a percentage between about 4% and about 10% by weight, and still more preferably at about 6%. The pH specific operating range for the conversion coating ranges between about 3.5 and about 6.5, with a more preferred range between about 4.0 and about 5.5. Any suitable buffering agent which will maintain the pH in this operating range may be used. However, in the preferred embodiment, this buffering of the solution is maintained by appropriate additions of phosphoric acid or sodium hydroxide.

It is to be understood that any suitable organic accelerator may be used. In the preferred embodiment, a sodium meta nitro benzene sulfonate is used. One such suitable compound is commercially available from BASF Wyandotte Corporation in Wyandotte, Mich. under the trade name GOLPANOL®MBS. This is an oxidizing agent for use in stripping baths prior to replating for electroplating. It is available in powder and as granules. Its composition is sodium 3-nitro benzene-1-sulfonate. Its molecular formula is $C_6H_4NNaO_5S$. Its molecular weight is 225. It is 95% assay. The water is 4% maximum. Sodium sulfate is 1–5%. Sodium carbonate is 0.5%. Chloride is 0.1% maximum. Its bulk density as a powder is 450 g/l and as granules is 720 g/l. Its pH in a 10% aqueous solution is 8. Its ignition temperature is 380° C. and its $LD_{50}$ is 3.2 g/kg (mice). Its chemical name is sodium-m-nitro benzene sulfonate. Its chemical family is an aryl sulfonate. A synonym is basotol. Its solubility in water at 20° C. is about 310 g/l. As a powder, it appears as a pale yellow, coarsely ground powder with no characteristic odor. It is stable up to 370° C.

The lubricant composition of the present invention uses water soluble components as a carrier for the insoluble ingredients, as well as a lubricant at low temperatures. These soluble components, which may preferably include, but are not limited to, sodium salts of stearic and palmitic acid, provide a film plasticity on the surface which precedes metal movement in the early milliseconds of metal forming, i.e. wherein the metal temperature is below 200° F. The use of a polymeric glycol, which preferably has a high molecular weight, functions in a like manner, in that it is a waxy material at temperatures above 200° F. and provides a thin, pasty coating as metal is pulled through a die or header. The insoluble ingredients, which preferably include, but are not limited to, calcium stearate, barium stearate and lithium stearate are uniformly dispersed and begin to melt and lubricate at temperatures above 200° F. The residual coating after one extrusion is usually present in sufficient quantity to allow another metal reduction without reapplying fresh lubricant. The chemical dispersion is achieved with a small percentage (about 3% by weight) of a sodium salt of a carboxylated acrylic polyelectrolyte. This ingredient, although optional, is quite advantageous, especially for use with difficult forming operations, such as forming a hex head out of a round shaped metal. During extrusions such as this, it is believed that the above-mentioned sodium salt is important for maintaining the necessary dispersion in conjunction with the alkaline ingredients and the polyglycol. This sodium salt compound is added as a separate component into a process tank, and is not premixed with the main lubricant composition. For example, once the lubricant composition of the present invention is dissolved in a process tank in concentrations as disclosed herein, after a process temperature between about 148° F. and about 158° F. is reached, the sodium salt compound is added. It is further believed that the resulting film strength and uniformity of the coated steel is related to this sodium salt dispersing agent. The mechanism for lubricant deposition is a physical one. As mentioned further above, it is not a chemically reactive lubricant. The lubricant composition of the present invention, with its soluble and insoluble components, is deposited on the metal during the immersion in solution. The water is removed by a dryer before any extrusion operation. A forced hot blow off achieves complete drying, normally accomplished by placement in a 200° F. to 275° F. dryer for approximately 15–20 minutes.

Without being bound to any theory, it is further believed that the uniformity and quantity of lubricant deposited may be enhanced by pre-treatment of the metal (for example, steel) surface with a resulting conversion coating of an iron phosphate/iron oxide nature. It appears that the pickled steel surface, without such a pre-treatment conversion coating, may at times be too irregular and too inconsistent for sufficient quantities of lubricant, especially when severe extrusions are called for. The application of this conversion coating with the meta-nitrobenzene accelerator produces coatings at a pH range of 4.0 to 5.5 of more than 100 mg/ft$^2$ to 125 mg/ft$^2$. It is believed that this is important for successful severe extrusions.

This conversion coating may be used with the lubricant of the present invention, which lubricant composition either includes the dispersing agent, such as TAMOL 960 or does not include such a dispersing agent. However, in the preferred embodiment, and generally for severe extrusions, the conversion coating is used in conjunction with the addition of this dispersing agent to the lubricant composition of the present invention.

Without being bound to any theory, it is believed that the many advantageous aspects of the present invention are a result of the blend of aqueous alkaline stearate and palmitate compounds, polymeric glycol, carrier/translucent film barrier compound, buffering and solubilizing agents. It is believed that further advantages stem from the present invention's water base, non-oil system. The steel drawing and extrusion industry prefers not to apply and transfer oiled steel parts when a water base dried-in-place lubricant film is available, such as the lubricating composition of the present invention.

Further advantages of the process of the present invention include the savings in time. As a comparison, FIG. 1 is a flow diagram of the typical prior art process. This requires an alkaline clean 100 of the metal, a subsequent hot water rinse 110 and an acid pickle, normally by sulfuric acid 112 in order to adequately clean and derust and descale the surface. After this, a cold water rinse 114 follows, then a hot water rinse 116 and a zinc phosphate dip 118. This is followed by a cold water rinse 120, and a neutralizer 122. Then there is a reactive lubricant dip 124, subsequent drying 126, after which the metal is sent to the bench for subsequent forming.

Figure 2:
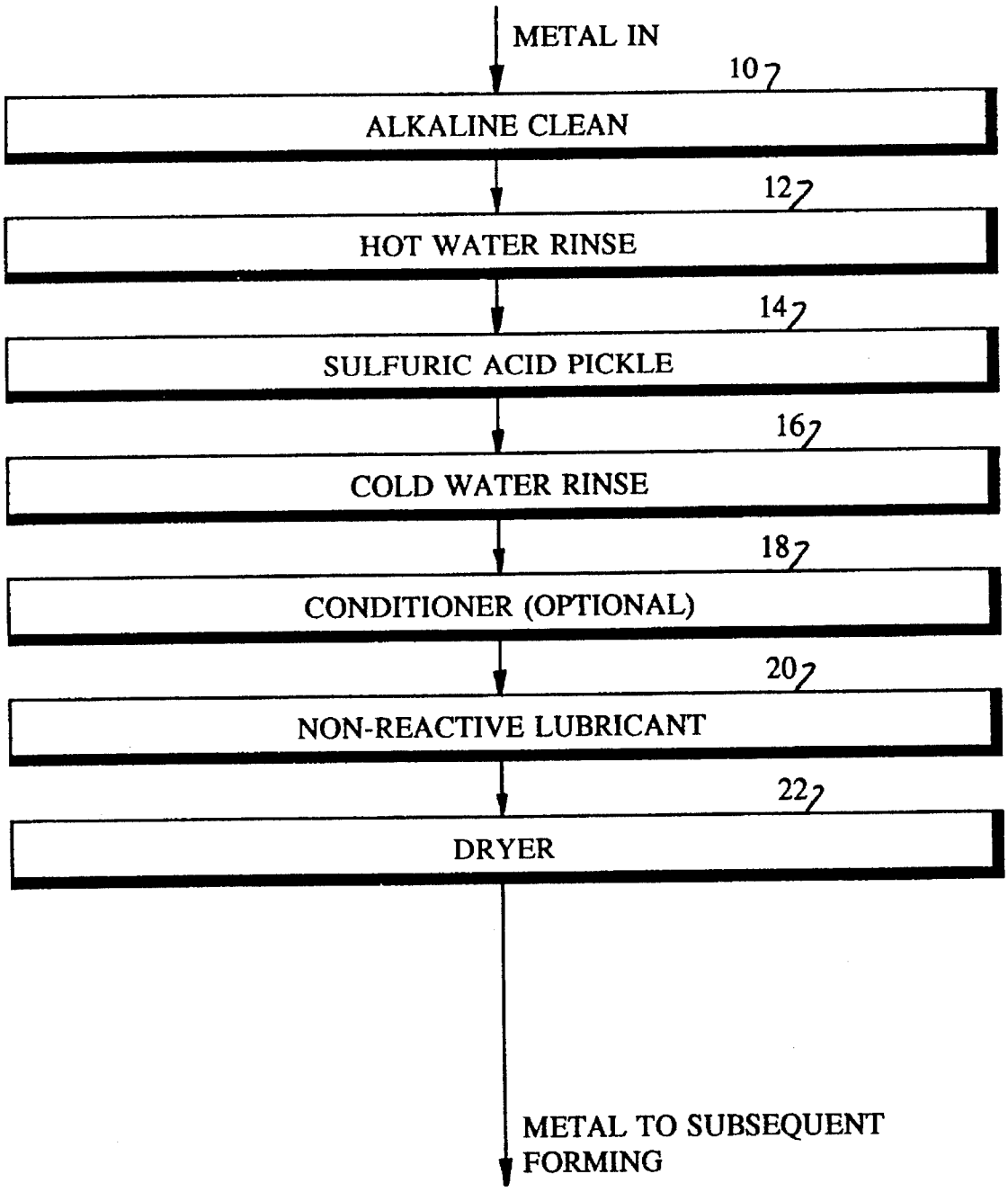
FIG. 2 is a flow diagram of a process according to the present invention for lubricating metal prior to cold forming.

On the contrary, the process of the present invention has far fewer steps and does not involve the hazardous waste and sludge removal as outlined further hereinabove relative to the prior art process. As shown in FIG. 2, in the present invention, the metal is first alkaline cleaned 10, hot water rinsed 12, sulfuric acid pickled 14, and thereafter cold water rinsed 16. Up to this point, the process is similar to that of the prior art. However, in the present invention, at this point an optional iron phosphate/iron oxide conversion coating may be applied 18. The non-reactive lubricant composition of the present invention is then disposed, not reacted on the metal surface, as shown in step 20, after which subsequent drying 22 takes place. The metal is then sufficiently lubricated and ready for subsequent forming. The process of the present invention is very advantageous in that after the normal surface preparation as mentioned above, there is subsequently only a one-step lubricant immersion or, if desired, an additional pre-lubricant non-zinc conditioning step. The lubricant composition of the present invention is essentially non-reactive and utilizes the diversity of the plastic range of its individual components to provide lubricity and staying power within the dried lubricant film.

A further advantage of the present invention is water conservation. Since the process tanks are run an average of 25° F. to 30° F. lower than conventional tanks, less water is lost through evaporation. Further, since fewer tanks are used due to the fewer steps in the inventive process, including less rinsing, much less water is used, fewer tanks need to be charged and disposed of, and tanks containing the inventive composition need to be disposed of less often. This results in a water savings of up to millions of gallons per year.

The so called "plastic" state of a film is the pasty range of the substance whereby it is neither solid nor liquid. A coating which will suffice in many operations will arrive at its plastic state at a relatively low temperature and maintain some degree of plasticity for an extended period. Therefore, combinations of different melting point lubricants, as in the lubricating composition of the present invention, can play an instrumental role in a heading operation with multiple blows. When one component of a lubricant is expended and higher temperatures are reached, another component can enter its plastic state for the remaining blows.

A further advantage of the optional conditioner is that this conversion coating provides for absorptive and barrier purposes when more severe metal transformations are demanded. The chemical accelerator used allows for maximum coating weights, and the pH operating range allows for preferred deposition. Although not necessary with less severe metal transformations, this conditioning stage may lend to greater lubricant uniformity without any deleterious effects. Measurable iron phosphate coatings of 125 mg/ft$^2$ to 200 mg/ft$^2$ are common on steel surfaces immersed in the conditioning bath for 5–6 minutes at 165° F. With this base from the inventive conversion coating, subsequent lubricant coatings of the present invention have been measured at 600 mg/ft$^2$ to 1100 mg/ft$^2$.

The particle size and dispersion of the insoluble components of the present invention are an important aspect regarding the lubricant film's uniformity and distribution. Agitation in the lubricant process tank, i.e. the tank whereby the solution is dissolved and ready to receive the metal to be lubricated, is important. In the process of the preferred embodiment, a system whereby the lubricant solution in the process tank is pumped from the bottom of one or both ends of the process tank and then recirculated back through a series of nozzled horizontal pipes near the solution level is generally very effective.

Processing temperatures in the process tank may range from about 140° F. to 170° F., with a more preferred range being between 150° F. to 165° F. Although still operable, below 140° F., some gelling occurs, and over 170° F., the quantity of lubricant coating deposited is reduced.

To further illustrate the composition, the following examples are given. It is to be understood that these examples are provided for illustrative purposes and are not to be construed as limiting the scope of the present invention.

EXAMPLE 1

C-LUBE 10 and C-LUBE 16 are made in the following manner. These soap lubricants are formed to a specific purity level, moisture content and saponification by means of the following procedure. The saponification is about 98%. In the following example, either the stearic (10) or stearic/palmitic (16) is added, dependant upon whether C-LUBE 10 (sodium stearate) or C-LUBE 16 (sodium palmitate) is desired.

Saponification is the alkaline hydrolysis of a fatty acid to yield a soap. For the specific soap lubricants, C-LUBE 10 and C-LUBE 16, this requires a reactor and a time/temperature relationship.

The acid (stearic (10) or stearic/palmitic (16)) is added in powder form to a steam jacketed mixing vessel. Steam is turned on and maintained until the powdered acid is completely melted, normally about 45 to 60 minutes at 190° F. A ribbon-like mixing blade is engaged and turns from this point forward. A 50% by weight concentration of liquid sodium hydroxide is now added across the surface of the hot stearic acid by means of a multi-hole header to ensure uniform dispersement. As the sodium from the sodium hydroxide displaces the hydrogen from the hydroxyl group of the acid, the resultant salt precipitates. Therefore, the previously liquified acid eventually becomes completely solidified when all of the sodium hydroxide is added and reacted. The steam is turned off after the final sodium hydroxide is added, and the pasty mixture is tumbled with the ribbon mixing blade for another two hours. The cooled mixture is now an ivory, white soap of a specific moisture content (10: 34%–40%, 16: 20%–24%) and neutral acid/alkali content. The pH ranges between about 7.6 and about 8.2. In certain cases, the powder lube is allowed to sit for 24 hours and then reduced to a smaller average particle size by means of mechanically pulverizing the soap in a hammer mill grinder operation. The final product is then filtered to remove any large particles, and drummed. The overall reaction has proceeded as follows:

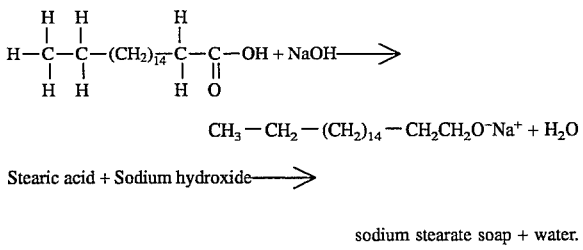

For the C-LUBE 16, the same reaction occurs, except the starting product is palmitic acid, and the ending product is sodium palmitate soap.

C-lube 10 is an off white, free flowing flake mixture readily soluble in warm water. The working solution is an off- white stable blend of the pure organic soaps, and operates at temperatures from 165° F. to 175° F. The C-lube 16 is an off white free flowing flake mixture which is readily soluble in warm water. The working solution is an off white, stable blend of the pure organic soaps, and operates at temperatures between about 165° F. and 175° F.

EXAMPLE 2

A lubricating composition according to the present invention is made from mixing the following ingredients 45.0% BORAX 10 mole; 2.0% DRYMET; 10.0% C-LUBE 16 as formulated in Example 1; 7.5% polyethylene glycol 4600; 1.5% TRITON H-66; 15.0% barium stearate; 5.0% calcium stearate; 7.5% C-lube-10 as formulated in Example 1; 6.5% lithium stearate. The resultant mixture was a fluffy, white powder having no noticeable odor, and was stored in a suitable drum.

EXAMPLE 3

A lubricating composition of the present invention was formed by mixing the following ingredients: 20.0% BORAX 10 mole; 3.0% DRYMET; 15.0% C-lube 16 as formulated in Example 1; 10.0% PLURACOL 4600; 2.5% TRITON H-66; 19.0% barium stearate; 8.5% calcium stearate; 11.5% C-lube 10 as formulated in Example 1; and 10.5% lithium stearate. The resultant mixture was a fluffy, white powder having no noticeable odor and was stored in a suitable drum.

EXAMPLE 4

A suitable process concentration of the lubricating composition of the present invention in a water solution has a range of between about 8 ounces lubricating composition per gallon of water to about 40 ounces lubricating composition per gallon of water. A preferable concentration has been found to be about 30 ounces lubricating composition per gallon of water.

In order to measure concentration of lubricating compositions in the process tank, for the soluble components, a total alkalinity titration is performed, and for the insoluble components, a solids split by acid and centrifuge is performed.

EXAMPLE 5

Over 1,200,000 $ft^2$ of various carbon grade and alloy steel tubing has been run (equivalent to about 4 months of total production) through a production tank with no sign of interference from contaminants dragged in by the process. Conventional lubricants would have to be discarded after about 900,000 $ft^2$.

EXAMPLE 6

1010 carbon steel tubing was lubricated with the lubricating composition of the present invention as formulated in Example 2. About 30 ounces lubricating composition per gallon of water was dissolved in the process tank. No pre-lubricant conditioning conversion coating was applied. The lubricated steel tubing was double passed without intermediate annealing or chemical processing, with cross sectional reductions of 34% on the first pass and 39% on the second pass. Both passes were pulled at maximum bench speeds. The first pass starting size had an outer diameter of 0.625" and an inner diameter of 0.527" and a wall thickness of 0.049". The intermediate size had an outer diameter of 0.565", and an inner diameter of 0.495", and a wall thickness of 0.035". The final pass size had an outer diameter of 0.440", an inner diameter of 0.385" and a wall thickness of 0.0275".

The tubing exhibited excellent surface finishes, and had a measured inner diameter smoothness of between about 8 and about 10 RMS.

EXAMPLE 7

1020 AK carbon steel tubing had a pre-lubricant conditioning conversion coating applied thereto. This coating consisted essentially of 5% by volume mono-sodium phosphate, and between about 4% and about 10% by volume sodium meta nitrobenzene sulfonate. The pH specific operating range for the conversion coating ranged between about 4.0 and about 5.5, this range being maintained by appropriate additions of phosphoric acid or sodium hydroxide. The lubricating composition of the present invention was formulated as in Example 3. About 30 ounces lubricating composition per gallon of water was dissolved in the process tank. After a process temperature between about 148° F. and about 158° F. was reached, 3.0% (by weight of the lubricating composition) TAMOL 960 was added. The steel tubing was then lubricated with this lubricating composition. The conditioned and lubricated steel tubing was single passed with cross sectional reduction of 44% from an outer diameter of 1.050", an inner diameter of 0.77" and a wall thickness of 0.140" to an outer diameter of 0.75", an inner diameter of 0.527", and a wall thickness of 0.111".

This tubing exhibited an excellent surface finish, and a measured inner diameter smoothness ranging from about 10 and about 20 RMS.

EXAMPLE 8

1012 AK carbon steel tubing had a pre-lubricant conditioning conversion coating applied thereto. This coating consisted essentially of 5% by volume mono-sodium phosphate, and between about 4% and about 10% by volume sodium meta nitrobenzene sulfonate. The pH specific operating range for the conversion coating ranged between about 4.0 and about 5.5, this range being maintained by appropriate additions of phosphoric acid or sodium hydroxide. The lubricating composition of the present invention was formulated as in Example 3. About 30 ounces lubricating composition per gallon of water was dissolved in the process tank. After a process temperature between about 148° F. and about 158° F. was reached, 3.0% (by weight of the lubricating composition) TAMOL 960 was added. The steel tubing was then lubricated with this lubricating composition. The conditioned and lubricated steel tubing was single passed with cross sectional reduction of 38% from an outer diameter of 1.66", an inner diameter of 1.060", and a wall thickness of 0.300" to an outer diameter of 1.250", an inner diameter of 0.750" and a wall thickness of 0.250".

The tubing had an excellent surface finish and a measured inner diameter smoothness of between about 10 and about 20 RMS.

EXAMPLE 9

1020 steel rod was lubricated with the lubricating composition of the present invention as formulated in Example 2. About 30 ounces lubricating composition per gallon of water was dissolved in the process tank. No pre-lubricant conditioning conversion coating was applied. The lubricated steel rod was drawn down 45% without auxiliary dry box lubricant. This was then re-coated by the same lubricating composition for shipment to a customer with a 5 blow heading operation. The parts, namely hex head bolts, were satisfactorily formed.

EXAMPLE 10

1010 carbon steel tubing is lubricated with the lubricating composition of the present invention as formulated in Example 3. About 30 ounces lubricating composition per gallon of water is dissolved in the process tank. No pre-lubricant conditioning conversion coating is applied. The lubricated steel tubing is double passed without intermediate annealing or chemical processing, with cross sectional reductions of 34% on the first pass and 39% on the second pass. Both passes are pulled at maximum bench speeds. The first pass starting size has an outer diameter of 0.625" and an inner diameter of 0.527" and a wall thickness of 0.049". The intermediate size has an outer diameter of 0.565", and an inner diameter of 0.495", and a wall thickness of 0.035". The final pass size has an outer diameter of 0.440", an inner diameter of 0.385", and a wall thickness of 0.0275".

The tubing exhibits excellent surface finishes, and has a measured inner diameter smoothness of between about 8 and about 10 RMS.

While preferred embodiments, forms and arrangements of parts of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A composition for lubricating a metal workpiece prior to cold forming, the composition consisting essentially of:

an aqueous alkaline stearate compound adapted to, and present in an amount sufficient to impart metal lubrication between about 180° F. and about 320° F.;

an aqueous alkaline palmitate compound adapted to, and present in an amount sufficient to impart metal lubrication below about 160° F.;

an aqueous metallic stearate compound adapted to, and present in an amount sufficient to impart metal lubrication between about 320° F. and 440° F.;

a polymeric glycol adapted to, and present in an amount sufficient to provide temperature stability, act as a carrier for the aqueous compounds, and impart a waxy lubrication to the metal;

a compound adapted to, and present in an amount sufficient to act as a carrier for the aqueous compounds and to provide a translucent film barrier on the metal;

an alkaline buffering agent adapted to, and present in an amount sufficient to provide dispersion, viscosity and stability; and a hydrotropic agent adapted to, and present in an amount sufficient to solubilize the lubricating composition.

2. The lubricating composition as defined in claim 1, further consisting essentially of:

a dispersing agent for maintaining the aqueous compounds in solution; and a polyelectrolyte for imparting a cohesive film strength to the lubricating composition as it is dried on the metal workpiece.

3. The lubricating composition as defined in claim 1, wherein the alkaline stearate compound is selected from the group consisting of sodium stearate, calcium stearate, and mixtures thereof.

4. The lubricating composition as defined in claim 3, wherein the sodium stearate is present in an amount between about 10 wt. % and about 20 wt. %, and wherein the calcium stearate is present in an amount between about 6 wt. % and about 12 wt. %.

5. The lubricating composition as defined in claim 4 wherein the composition contains about 15 wt. % sodium stearate and about 8 wt. % calcium stearate.

6. The lubricating composition as defined in claim 1 wherein the alkaline palmitate compound is sodium palmitate.

7. The lubricating composition as defined in claim 6 wherein the sodium palmitate is present in an amount between about 10 wt. % and about 20 wt. %.

8. The lubricating composition as defined in claim 7 wherein the composition contains about 11 wt. % sodium palmitate.

9. The lubricating composition as defined in claim 1 wherein the metallic stearate compound is selected from the group consisting of barium stearate, lithium stearate, and mixtures thereof.

10. The lubricating composition as defined in claim 9 wherein the barium stearate is present in an amount between about 10 wt. % and about 25 wt. %, and wherein the lithium stearate is present in an amount between about 8 wt. % and about 25 wt. %.

11. The lubricating composition as defined in claim 10 wherein the composition contains about 18 wt. % barium stearate and about 11 wt. % lithium stearate.

12. The lubricating composition as defined in claim 1 wherein the polymeric glycol is selected from the group consisting of polyethylene glycol, polypropylene glycol, and mixtures thereof.

13. The lubricating composition as defined in claim 12 wherein the composition contains between about 4 wt. % and about 12 wt. % polyethylene glycol having an average molecular weight between about 4500 and about 4600.

14. The lubricating composition as defined in claim 13 wherein the composition contains about 10 wt. % polyethylene glycol having an average molecular weight of 4500.

15. The lubricating composition as defined in claim 13 wherein the composition contains about 10 wt. % polyethylene glycol having an average molecular weight of 4600.

16. The lubricating composition as defined in claim 1 wherein the carrier and translucent film barrier compound is sodium tetra borate.

17. The lubricating composition as defined in claim 16 wherein the sodium tetra borate is present in an amount between about 15 wt% and about 50 wt. %.

18. The lubricating composition as defined in claim 17 wherein the composition contains about 22 wt. % sodium tetra borate.

19. The lubricating composition as defined in claim 1 wherein the alkaline buffering agent is sodium meta silicate.

20. The lubricating composition as defined in claim 19 wherein the sodium meta silicate is present in an amount between about 2 wt. % and about 5 wt. %.

21. The lubricating composition as defined in claim 20 wherein the composition contains about 3 wt. % sodium meta silicate.

22. The lubricating composition as defined in claim 1 wherein the hydrotropic agent is a potassium salt of a phosphate ester.

23. The lubricating composition as defined in claim 22 wherein the potassium salt of a phosphate ester is present in an amount between about 2 wt. % and about 10 wt. %.

24. The lubricating composition as defined in claim 23 wherein the composition contains about 4 wt. % potassium salt of a phosphate ester.

25. The lubricating composition as defined in claim 2 wherein the dispersing agent and the polyelectrolyte are a sodium salt of a carboxylated acrylic polyelectrolyte.

26. The lubricating composition as defined in claim 25 wherein the sodium salt of a carboxylated acrylic polyelectrolyte is present in an amount between about 0.1 wt% and about 5 wt. %.

27. The lubricating composition as defined in claim 26 wherein the composition contains about 3.0 wt. % sodium salt of a carboxylated acrylic polyelectrolyte.

28. A composition for lubricating a metal workpiece prior to cold forming, the composition consisting essentially of:

an aqueous alkaline stearate compound adapted to, and present in an amount sufficient to impart metal lubrication between about 180° F. and about 320° F., wherein the alkaline stearate compound is selected from the group consisting of sodium stearate, calcium stearate, and mixtures thereof, and wherein the composition contains about 15 wt. % sodium stearate and about 8 wt. % calcium stearate;

an aqueous alkaline palmitate compound adapted to, and present in an amount sufficient to impart metal lubrication below about 160° F., wherein the alkaline palmitate compound is sodium palmitate, and wherein the composition contains about 11 wt. % sodium palmitate;

an aqueous metallic stearate compound adapted to, and present in an amount sufficient to impart metal lubrication between about 320° F. and 440° F., wherein the metallic stearate compound is selected from the group consisting of barium stearate, lithium stearate, and mixtures thereof, and wherein the composition contains about 18 wt. % barium stearate and about 11 wt. % lithium stearate;

a polymeric glycol adapted to, and present in an amount sufficient to provide temperature stability, act as a carrier for the aqueous compounds, and impart a waxy lubrication to the metal, wherein the polymeric glycol is selected from the group consisting of polyethylene glycol, polypropylene glycol, and mixtures thereof, and wherein the composition contains about 10 wt. % polyethylene glycol having an average molecular weight of 4500;

a compound adapted to, and present in an amount sufficient to act as a carrier for the aqueous compounds and to provide a translucent film barrier on the metal, wherein the carrier and translucent film barrier compound is sodium tetra borate, and wherein the composition contains about 22 wt. % sodium tetra borate;

an alkaline buffering agent adapted to, and present in an amount sufficient to provide dispersion, viscosity and stability, wherein the alkaline buffering agent is sodium meta silicate, and wherein the composition contains about 3 wt. % sodium meta silicate; and a hydrotropic agent adapted to, and present in an amount sufficient to solubilize the lubricating composition, wherein the hydrotropic agent is a potassium salt of a phosphate ester, and wherein the composition contains about 4 wt. % potassium salt of a phosphate ester.

29. The lubricating composition as defined in claim 28, further comprising:

a dispersing agent for maintaining the aqueous compounds in solution; and a polyelectrolyte for imparting a cohesive film strength to the lubricating composition as it is dried on the metal workpiece;

wherein the dispersing agent and the polyelectrolyte are a sodium salt of a carboxylated acrylic polyelectrolyte, and wherein the composition contains about 3.0 wt. % sodium salt of a carboxylated acrylic polyelectrolyte.

30. The lubricating composition as defined in claim 28 wherein the metal workpiece is steel tubing.

31. The lubricating composition as defined in claim 28 wherein the metal workpiece is steel wire.

32. A process for lubricating a metal workpiece outer surface prior to cold forming, the process comprising the step of:

disposing a non-reactive lubricating composition on the workpiece outer surface, the outer surface having been alkaline cleaned, hot water rinsed, acid pickled, and cold water rinsed, the lubricating composition consisting essentially of:

an aqueous alkaline stearate compound adapted to, and present in an amount sufficient to impart metal lubrication between about 180° F. and about 320° F.;

an aqueous alkaline palmitate compound adapted to, and present in an amount sufficient to impart metal lubrication below about 160° F.;

an aqueous metallic stearate compound adapted to, and present in an amount sufficient to impart metal lubrication between about 320° F. and 440° F.;

a polymeric glycol adapted to, and present in an amount sufficient to provide temperature stability, act as a carrier for the aqueous compounds, and impart a waxy lubrication to the metal;

a compound adapted to, and present in an amount sufficient to act as a carrier for the aqueous compounds and to provide a translucent film barrier on the metal;

an alkaline buffering agent adapted to, and present in an amount sufficient to provide dispersion, viscosity and stability; and a hydrotropic agent adapted to, and present in an amount sufficient to solubilize the lubricating composition.

33. The process as defined in claim 32, wherein before the lubricating composition is disposed on the workpiece outer surface, an iron phosphate/oxide conversion coating is applied to the surface, and wherein the coating composition consists essentially of:

an inorganic acidic salt for laying down the coating; and an organic accelerator for increasing the amount of coating laid down.

34. The process as defined in claim 32 wherein the metal workpiece is steel tubing.

35. The process as defined in claim 32 wherein the metal workpiece is steel wire.

* * * * *